United States Patent [19]

Paulus

[11] Patent Number: 4,710,110

[45] Date of Patent: Dec. 1, 1987

[54] FLUID PUMP APPARATUS

[76] Inventor: Henry G. Paulus, 50 Bilodeau Ct., Burlington, Vt. 05401

[21] Appl. No.: 875,017

[22] Filed: Sep. 22, 1986

[51] Int. Cl.[4] ..... F04C 18/18

[52] U.S. Cl. ..... 418/15; 418/183; 418/189; 418/206

[58] Field of Search ..... 418/15, 183, 188, 189, 418/205, 206

[56] References Cited

U.S. PATENT DOCUMENTS

| | | | |
|---|---|---|---|
| 1,076,299 | 10/1913 | Marshall | 418/188 |
| 1,418,741 | 6/1922 | Stallman | 418/188 |
| 1,644,817 | 10/1927 | Conant et al. | 418/183 |
| 1,862,440 | 6/1932 | Tacchi | 418/188 |
| 1,902,347 | 3/1933 | Vogt et al. | 418/15 |
| 2,678,155 | 5/1954 | Durham | 418/185 |
| 3,259,073 | 7/1966 | Burtis | 418/188 |
| 3,303,792 | 2/1967 | Littlewood | 418/189 |
| 3,601,515 | 8/1971 | Pelizzoni | 418/206 |

FOREIGN PATENT DOCUMENTS

| | | | |
|---|---|---|---|
| 2339872 | 2/1975 | Fed. Rep. of Germany | 418/183 |

*Primary Examiner*—John J. Vrablik

[57] ABSTRACT

This is a compressor apparatus having a central cavity, a fluid inlet and a fluid outlet coupled to the cavity, a pair of impellers having hollow interiors positioned in the cavity between the inlet and the outlet, each impeller having a plurality of exernal teeth engaging and intermeshing with the teeth on the other impeller and adapted for compressing a fluid, introduced into the cavity, means for rotating the impellers to draw the fluid out of the interior of the impellers and compress the fluid in the cavity and to force the compressed fluid out of the cavity through the outlet, each impeller having a fluid inlet on one end coupling the inlet of the cavity to the hollow interior of the impeller, each impeller further having a plurality of slots between each of the teeth on the impeller, said slots connecting the hollow interior of the impeller to the cavity through which fluid, introduced into the interior of the impeller, can exit the impeller and pass into the cavity, and a gate positioned in the hollow interior of each impeller and arranged to close selected slots in said impellers, as said impellers are rotated in said cavity around said gates, to prevent compressed fluid from passing back into the interiors of the impellers.

9 Claims, 7 Drawing Figures

FLUID PUMP APPARATUS

BACKGROUND OF THE INVENTION

1. Field of the Invention

This relates generally to fluid pumps and more particularly to an improved rotary pump or compressor, adapted to be more efficient in operation, have reduced wear and to be more economical to operate. The compressor of the invention utilizes gear rotors having hollow interiors from which the fluid to be compressed is introduced.

2. Prior Art

Rotary mechanisms that use gear like rotors having hollow centers have been known and used in the past. One such apparatus is shown in U.S. Pat. No. 1,076,299. This patent teaches a steam motor having two gear rotors in which each rotor, which has a plurality of slots therein, rotates around an internal sleeve having but a single slot therein such that steam can pass from the center of the rotor only when a slot in the rotor is aligned with the single slot in the internal sleeve. Thus steam can pass out of the center of the rotor only when the rotor is in a predetermined position. The expanding steam, exiting out of the center of each rotor, when the rotors are in the proper position, tries to drive the two rotors in oppoiste directions so as to cause the device to be a motor.

The apparatus described in this patent is not suitable for use as a compressor and is very inefficient as a motor because the steam, after it passes through the slots into the region between the intermeshing teeth of the rotors, expands and applies an equal force in all directions. Thus, it, the expanding steam, also applies a force opposite to the direction the impellers are desired to turn, and this severely reduces the efficiency of the apparatus.

U.S. Pat. No. 1,418,741 also teaches a rotary mechanism having hollow, multiple slotted, rotors mounted on spindles having but a single slot therein. This pump also tends to be inefficient. The pressurizing action occurs only when two teeth of the rotor engage. Thus as the teeth engage the pressure begins to increase and continues to increase until it is suddenly relieved when the slot in the rotor comes into alignment with the slot in the sleeve. This sudden relieving of the pressure causes irregular motions in the apparatus and a severe reduction in efficiency.

U.S. Pat. No. 3,259,073 describes a pump having a sun gear with a hollow internal chamber connected to an axially disposed outlet and surrounded with a plurality of planetary gears. The sun gear is provided with a plurality of openings communicating with its internal chamber and each opening is further provided with a check valve. These check valves are provided in order to prevent the compressed fluid, being pumped into the central chamber of the sun gear by the planetary gears, from flowing back out of the internal chamber.

None of these references teach the concept of drawing the fluid, being pumped, out of the center of the impellers by supplying each of the impellers with a plurality of slots, substantially all of which are open at all times. The fluid so drawn out of the center of the impellers is compressed by the rotary action of the impellers and the efficiency of the pump is significantly increased.

SUMMARY OF THE INVENTION

Accordingly, it is an object of the invention to provide a compressor having a central cavity, with a fluid outlet coupled to the cavity, at least one pair of impellers or rotors having hollow interiors connected to a fluid input, positioned in the central cavity. Each impeller has a plurality of slots interposed with a plurality of teeth. The teeth on each impeller engages the teeth on the other impeller and acts in concert with the teeth on the other impeller to draw the fluid, to be compressed, out of the center of the impeller through substantially all of the slots, all of the time. These teeth on the impellers also causes the fluid to be compressed or pressurized. Gating or valving means are provided in each of the impellers to prevent the compressed fluid from being reintroduced into the center of the impellers and act together with the teeth in causing the compressed fluid to pass out of the compressor's outlet. The compressor of the present invention further is preferably provided with means for driving the impellers in a rotary fashion so that the only wear of the impeller teeth is caused by fluid action and not by driving action of the teeth one upon the other. It should, of course, be understood that, instead of using driving means such as gears, one of the impellers can be directly connected to a driving source such as a motor so that the teeth of the impeller being driven by the motor will engage the teeth on the other impeller and thus directly drive the other impeller.

It is a further object of the invention to provide a compressor having the gate fixidly positioned within the hollow interior of each impeller and arranged to close a selected number of the slots in each of the impellers as each of the impellers are rotated in its cavity, past the gate. By making the gate cover less than a quarter of the slots at any one time, substantially all of the slots are kept open, at all times to permit fluid to pass out of the interior of the impeller into the region between the teeth. Each gate is positioned in the interior of a respective impeller immediately adjacent the outlet of the pump so as to prevent the compressed fluid from passing back into the interiors of the impellers and thus aiding the teeth in forcing the compressed fluid to be out of the outlet orifice.

These and other objects of the invention are further discribed in the detailed discription of the present invention given below.

DESCRIPTION OF THE INVENTION

The apparatus of the invention basically comprises a pump or a compressor for fluids or semi-fluid plastic materials that will flow under pressure.

Figure 1:
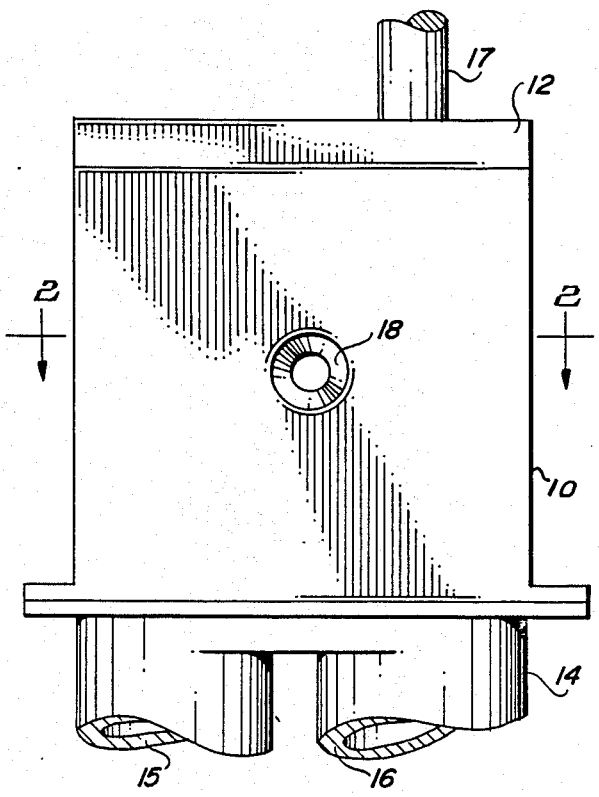
FIG. 1 shows an overall exterior view of the apparatus as presently built.
Figure 4:
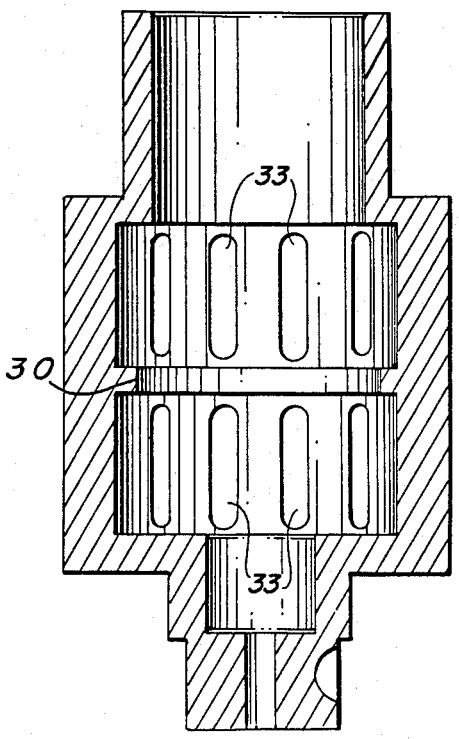
FIG. 4 shows a transverse sectional view of the apparatus taken at right angles to that of FIG. 3.
Figure 2:
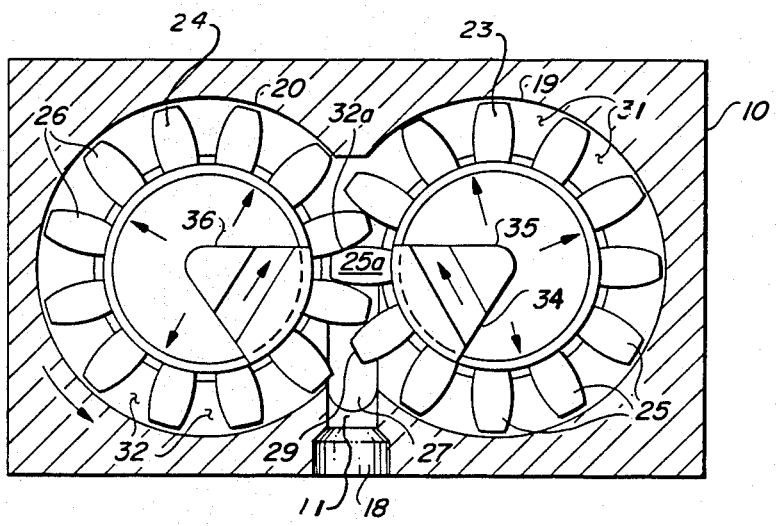
FIG. 2 shows a sectional view of the apparatus of the invention, taken along the lines 2—2.
Figure 6:
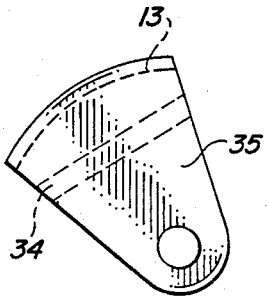
FIG. 6 shows a top view of the valve of the invention.
Figure 7:
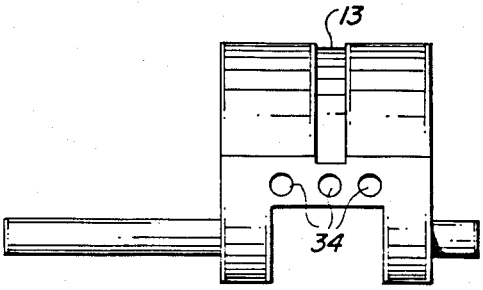
FIG. 7 shows a side view of the valve of FIG. 6.
Figure 3:
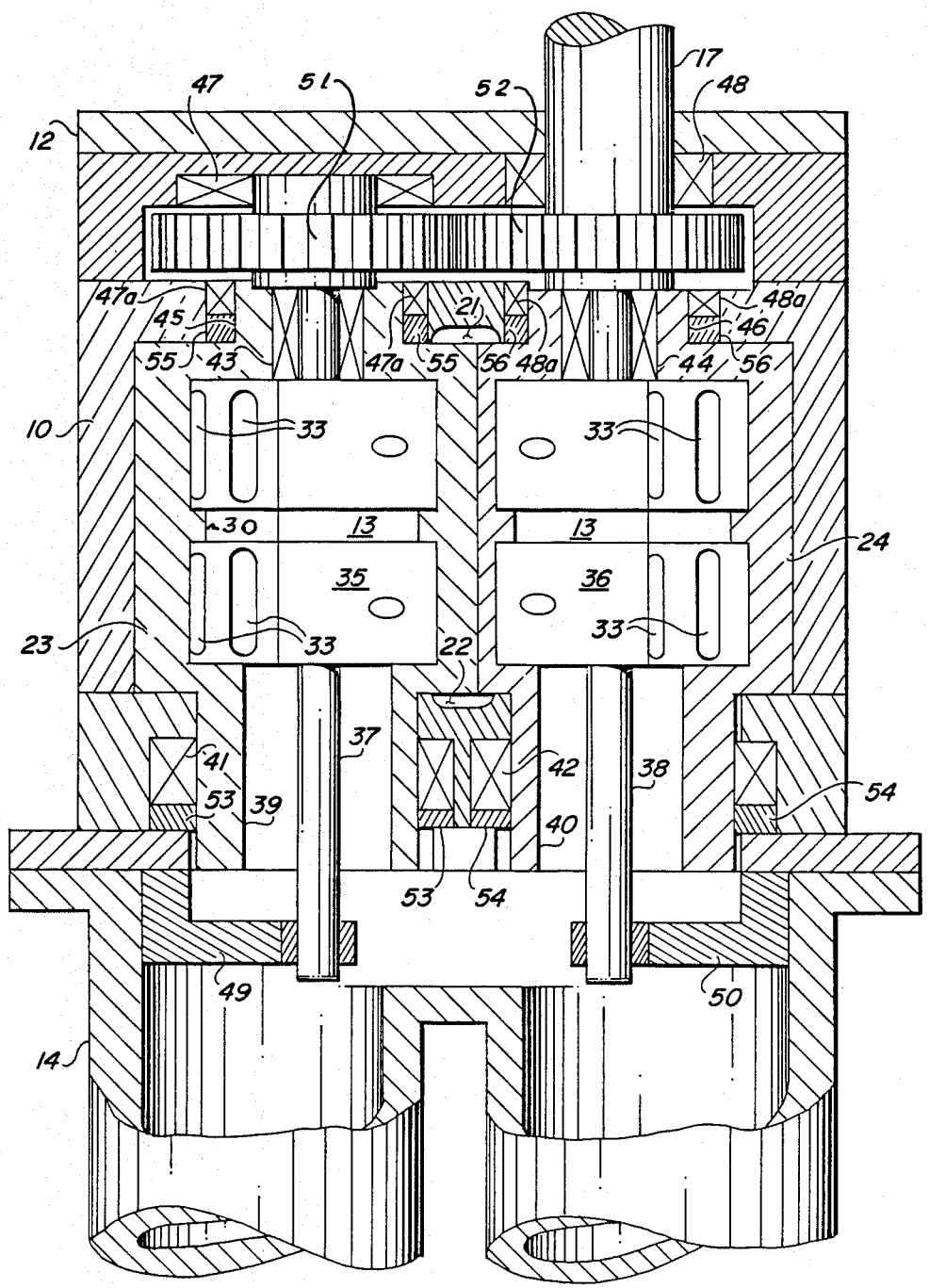
FIG. 3 shows a transverse sectional view of the apparatus.
Figure 5:
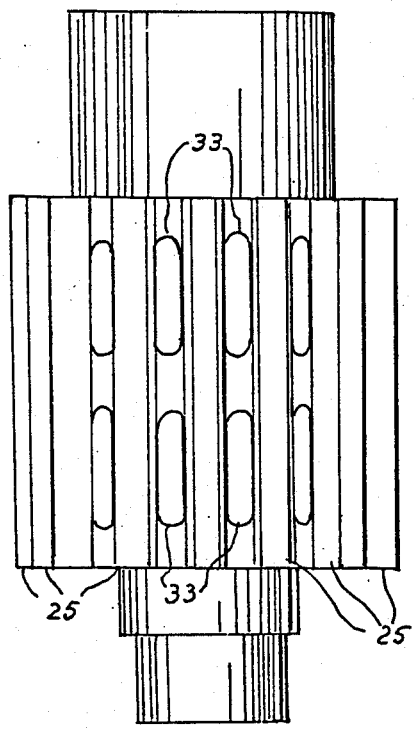
FIG. 5 shows one of the rotors of the apparatus.

Shown in FIG. 1 is an exterior view of the preferred embodiment of the compressor of the present invention. This comprises a hollow housing 10 provided with a central cavity an end cap 12 and an inlet cap 14 having two inlet pipes 15 and 16 affixed thereto. Passing through the end cap 12 is a drive shaft 17. In the center of the housing 10 is an outlet orifice 18 through which the compressed material is ejected from the housing 10. As shown in FIG. 2, the central cavity in the interior of the housing 10 is comprised of two intermeshing cylinders 19 and 20 each of which has an extended longitudinal axis. Where these cylinders interface there is provided a vertical groove 11 which mates with the outlet orifice 18.

As shown in FIGS. 2, 3, 4 and 5 there is rotatably mounted in the housing 10 and especially in the respective cylinders 19 and 20 respective, gear toothed, longitudinally extended, impellers or rotors 23 and 24. Each of these impellers has a cylindrical hollow center and each has an axis generally co-axial with the axis of the cylinder in which it resides. Each impeller is further respectivly provided with a series of circumferentially spaced, longitudionally extended, teeth 25 and 26. Each of these teeth 25 and 26 is parallel to the axis of the impeller. The impellers are set in the cylinders such that the teeth 25 on impeller 23 mesh with and are interposed between the teeth 26 of the impeller 24. Conversely the teeth 26 on impeller 24 become interposed between the teeth 25 on impeller 23. The teeth on each impeller are formed with sides elliptical in cross-section as shown in FIG. 2. Each tooth further has its tip 29 provided with the same radius as the internal radius of the silo-like cylinder in which the impeller resides. The external diameter of each rotor, i.e. from tooth tip to tooth tip, is identical to or only slightly smaller than the internal diameter of the cylinder in which it resides. In this way there is provided only clearance sufficient for lubricant between the tips of the impeller teeth and the walls of the cylinders.

The pockets 31 between the teeth 25 of the impeller 23 and the pockets 32 between the teeth 26 of impeller 24 are each provided with an opening, such as a slot 33, that provides communication between the interior of the impeller and its exterior. In the center of each impeller 23 and 24 there is provided a respective pie shaped, gate or valving mechanism 35 and 36. These gates are held in the hollow interior of each impeller such that they are fixed with respect to the surrounding cavity while pemitting the impeller in which they are positioned rotate around them. Thus each gate is held in the hollow center of a respective impeller and each gate has a radius to match the internal radius of the hollow interior of the impeller, in which it resides, such that the gate successively closes off selected ones of the slots in the impeller as the impeller rotates around the respective gate held in its interior.

The teeth, on each impeller, are each formed such that the teeth of each impeller mates with the teeth of the other impeller. In other words these teeth on the impellers intermesh in a gear like manner. That is, each tooth snugly fits in a pocket formed between two of the teeth on the other impeller. Each tooth, on each impeller further is provided with a slight hemispherical clearance or recess at the very bottom or root of each pocket, so that as the teeth of the impellers mesh, the fluid is squeezed out of the pocket into horizontal recesses 21 and 22 in the end cap 12 and inlet cap 14 respectively that meet with the vertical groove 11 from whence it, the compressed fluid, passes out of the outlet orifice 18.

Each of the impellers are respectively mounted in the inlet end 14 of the housing 10, for rotation on hollow end shafts 39 and 40. These shafts are journaled in respective bearings 41 and 42 together with suitable packing materials or seals 53 and 54 respectively to prevent any seepage, of the compressed fluid, from by passing these bearings 41 and 42 and passing out of the housing 10.

The other end of each impeller 23 and 24 is provided with partially hollow trunnions 45 and 46 respectively. These trunnions are journaled in respective bearings 47, 47A, 48 and 48A and provided with suitable packing materials or seals 55 and 56 respectively. These trunnions are further provided with intermeshing driving gears 51 and 52. Also affixed to trunnion 46 is the drive shaft 17 which is, in turn, connected to a suitable power source, not shown, such as a motor that can drive the gears 51 and 52, thus preventing the necessity of having the teeth on the impellers being used to do the driving. If desired, of course, these teeth can be used to do the driving of the other rotor and the use of gears 51 and 52 avoided. The root of each pocket on each impeller is also provided with a plruality of openings such as a series of round holes or, as shown, a plurality of slots 33 parallel to the longitudinal axis of the impeller. The slots in each rotor interconnect the interior of the respective rotor with the surrounding cavity.

Each impeller 23 and 24 can be further provided, if necessary, with a central, circumferential, reinforcing rib 30. Such a rib is required if the ratio of the the length of the rotor is such that the rib is necessary to strengthen the rotor wall. In such a case the slots 33 would be provided in pairs with one slot of each such pair. In the case where a rib is provided in the center of the rotor the gates 35 and 36 must be provided with a groove 13 so that the exterior edge of the gate will closely mate with the interior wall of the rotor in which the gate is positioned. To reduce the effect of fluid drag each gate should be provided with a series of through holes 34. on either side of the rib.

In use the fluid to be compressed is permitted to pass into the housing through the inlets 15 and 16. As the impellers are spun by a motor (not shown), attached to the drive shaft 17, acting through the gears 51 and 52, the fluid is drawn, by the spinning impellers, through the inlets 15 and 16 and thence into the interior of the impellers 23 and 24 and thence through selected ones of the slots 33, that is, those ones of slots 33 that are not covered by the gates in the interiors of the impellers, into the cavity. Passsing through the slots, the fluid enters into the pockets 31 and 32 between the teeth of the respective impellers. The fluid, drawn into the pockets 31 and 32, is further carried, by the spinning action of the impellers to the region of the vertical groove 11 and the outlet orifice 18. The gates 35 and 36, in the center of each respective impeller 23 and 24, closes off selected ones of the slots 33 in each impeller. As the teeth of each impeller 23 and 24 enters the region of groove 11 they begin to engage the teeth of the other impeller. As these teeth continue to engage the teeth of the other impeller, the teeth of each impeller becomes sucessively projected into the pockets between the teeth of the other impeller so as to close off and substantially fill the pockets. Because the gates are closing off the slots 33 in this region the meshing action of the teeth compresses the fluid trapped there between and forces the fluid entrained in the pockets 31 and 32 out of the pockets through the horizontal recesses 21 and 22. As these recesses 21 and 22 communicate with the vertical groove 11 and the outlet 20 the compressed fluid passes out of the compressor casing through the orifice 18.

By having the teeth, of the impellers, mate with one another, as described above, they also serve to prevent the compressed fluid, from passing back into the other portions of the cylinders 19 and 20. As the engaged teeth begin to disengage a partial vacuum is created in the pocket from which the tooth is being withdrawn. This withdrawel action of the teeth, i.e. the vacuum action, further aids in drawing the fluid into the cavity so that it can be carried by the spinning impeller to the region of groove 11. As this action repeats itself more and more of the fluid is caried into the region of the vertical groove 11. The constrictive action of the outlet 18 aids the fluid in becoming compressed. As the impellers continue to spin, the above described compressing operation continues and a steady stream of compressed fluid passes out of the compressor.

While the invention has been particularly shown and descibed with reference to the preferred embodiment thereof, it will be understood, by those skilled in the art, that various changes in form and details of the apparatus and method may be made therein without departing from the spirit and scope of the invention and that the method is in no way restricted by the apparatus and that the scope of the invention is limited only by the appended claims.

What is claimed is:

1. A compressor having a central cavity having walls, a fluid inlet means including an inlet cap and a fluid outlet means including an outlet cap coupled to the cavity, at least a pair of intermeshing impellers each having a hollow interior positioned in the cavity between the fluid inlet means and the fluid outlet means, each impeller having a fluid inlet on at least one end coupled to the fluid inlet means of the cavity and to the hollow interior of each impeller, each impeller further having a plurality of external means, having pockets therebetween, each impeller further having a plurality of openings between said external means connecting the interior of each impeller with said pockets, means coupled to at least one of said impellers for rotating the impellers to draw fluid through the fluid inlet means to the cavity and into the hollow interior of the impellers and through the openings between substantially all of said external means into the pockets between the external means, said external means on each impeller adapted to intermesh with the external means on the other impeller for compressing the fluid introduced into the pockets between the external means and the walls of the cavity and force the compressed fluid out of the pockets through the fluid outlet means, and a gate fixedly positioned in the hollow interior of each impeller and positioned only immediately adjacent the fluid outlet means where the impellers intermesh and arranged to close only those selected ones of said openings in each of said impellers immediately adjacent said fluid outlet means as said impellers are rotated in said cavity and around said gate to prevent the compressed fluid from passing back into the interiors of the impellers.

2. The compressor of claim 1 wherein said openings, connecting the hollow interior of each impeller to the cavity through which the fluid, introduced into the interior of each impeller, can exit the interior of each impeller and pass into the cavity between the walls of the cavity and each impeller, are elongated slots longitudinal to the axis of the each impeller.

3. The compressor of claim 2 wherein said central cavity comprises at least two intersecting cylinders, each of the cylinders having a respective fluid inlet, and both of said cylinders being coupled to a common fluid outlet.

4. The compressor of claim 3 wherein each of said impellers is in a respective one of said intersecting cylinders between the inlets to the cylinders and the flud outlet means of said cavity, each of said impellers has a fluid inlet on one end coupling the inlet of its respective cylinder to the hollow interior of the impeller, said external means on each impeller comprises a plurality of external teeth, said external teeth on each impeller intermeshing, in a gear like manner, with the teeth on the other impeller and adapted for compressing the fluid introduced between the cavity walls and the impellers and forcing the compressed fluid out of the outlet, and each opening of said plurality of openings comprising a slot located between a respective pair of the teeth on the impeller.

5. The compressor of claim 4 wherein each of said pair of impellers has a shaft end positioned at the inlet end of its respective cylinder and a trunnion at the opposite end, and there is provided bearings supporting said impellers at said shaft end and at said trunnion end.

6. The compressor of claim 5 wherein said means coupled to the impellers for rotating the impellers to compress the fluid includes a drive shaft coupled to the trunnion end of one of said impellers and gear means coupled to the trunnion ends of both of said impellers.

7. The compressor of claim 6 wherein each impeller is provided with a circumferential reinforcing rib in its hollow interior.

8. The compressor of claim 7 wherein each said gate in each said impeller is provided with a groove that mates with said circumferential reinforcing rib of the impeller.

9. The compressor of claim 1 wherein each of said caps having a horizontal recess, perpendicular to the axis of the impellers, communicating with the fluid outlet means and the intermeshed external means to release compressed fluid retained between the intermeshed external means.

* * * * *